US006173844B1

(12) United States Patent
Avery

(10) Patent No.: US 6,173,844 B1
(45) Date of Patent: Jan. 16, 2001

(54) MERCHANDISE DISPLAY SYSTEM

(75) Inventor: Frederick M. Avery, Phoenix, AZ (US)

(73) Assignee: Gillette Canada Inc, Kirkland ( * ) Notice: Under 35 U.S.C. 154(b), the term of this patent shall be extended for 0 days.

(21) Appl. No.: 09/074,182

(22) Filed: May 7, 1998

(51) Int. Cl.[7] ..... B42F 7/00
(52) U.S. Cl. ..... 211/57.1
(58) Field of Search ..... 211/57.1, 54.1, 211/106, 70.6, 59.2

(56) References Cited

U.S. PATENT DOCUMENTS

| | | | | |
|---|---|---|---|---|
| 3,308,961 | | 3/1967 | Chelsey | 211/49 |
| 4,303,162 | | 12/1981 | Suttles | 211/49 |
| 4,502,741 | | 3/1985 | DeVries et al. | 312/108 |
| 4,705,175 | | 11/1987 | Howard et al. | 211/59 |
| 4,742,923 | * | 5/1988 | Calvert | 211/59.1 |
| 4,742,936 | | 5/1988 | Rein | 221/5 |
| 4,762,236 | | 8/1988 | Jackles, III et al. | 211/59 |
| 4,898,282 | | 2/1990 | Hawkinson et al. | 211/49 |
| 4,907,707 | | 3/1990 | Crum | 211/59 |
| 5,009,334 | * | 4/1991 | Bodkins | 211/59.1 |
| 5,069,349 | | 12/1991 | Wear et al. | 211/59.3 |
| 5,088,607 | | 2/1992 | Risafi et al. | 211/59.3 |
| 5,203,463 | | 4/1993 | Gold | 211/59.3 |
| 5,240,126 | | 8/1993 | Foster et al. | 211/59.3 |
| 5,255,802 | | 10/1993 | Krinke et al. | 211/184 |
| 5,366,099 | | 11/1994 | Schmid | 211/59.3 |
| 5,450,968 | | 9/1995 | Bustos | 211/59.2 |
| 5,542,552 | | 8/1996 | Yablans et al. | 211/59.3 |
| 5,562,217 | | 10/1996 | Salveson et al. | 211/59.3 |
| 5,634,564 | | 6/1997 | Spamer et al. | 211/59.3 |
| 5,855,282 | * | 1/1999 | Hardy | 211/59.1 |

* cited by examiner

*Primary Examiner*—Alvin Chin-Shue
*Assistant Examiner*—Sarah Purol
(74) *Attorney, Agent, or Firm*—David A. Howley

(57) ABSTRACT

A merchandise display system includes a support from which merchandise can be suspended. The support includes a rod with a hook at its free end. The rod is angled down towards its free end. A member on one side of the merchandise restricts movement of the merchandise about a first axis of the support. An additional member on another side of the merchandise restricts movement of the merchandise about the first axis of the support. The system further includes a pair of stoppers, one stopper being attached to the member near a free end of the member and the other stopper being attached to the additional member near a free end of the additional member. The stoppers restrict movement of the merchandise about a second axis of the support. The stoppers each include a pair of flexible flaps which enable merchandise to be inserted onto a support and removed from a support.

7 Claims, 2 Drawing Sheets

MERCHANDISE DISPLAY SYSTEM

BACKGROUND OF THE INVENTION

Systems for displaying merchandise in retail stores are well known. In one type of display system, a rod projecting from a support has a "hook" at the free end of the rod. The rod is angled downward from the support towards the aisle of the store Typically, the merchandise is contained in a package which has a hole in it near its top end. The merchandise is stocked on the rod by passing the hole in the packaging over the hook and then pushing the merchandise up the rod. When a consumer desires to purchase the merchandise, they grasp the front-most piece of merchandise and remove it from the rod by pulling the packaging off of the hook. Other pieces of merchandise will then gravity-feed down the rod towards the hook. The hook prevents these other pieces of merchandise from falling off of the rod.

A problem with such gravity feed rod and hook merchandise display systems is that there is no provision for preventing the merchandise from swinging about the rod from side to side or front to back. This swinging of the merchandise about the rod can occur when a piece of merchandise is removed from the hook. Such merchandise swinging does not provide a very professional and attractive presentation of the merchandise in the eyes of the consumer.

SUMMARY OF THE INVENTION

In accordance with the invention, a merchandise display system includes a support from which merchandise can be suspended and means for restricting movement of the merchandise about the support. By restricting movement of the merchandise about the support, a more professional presentation of the merchandise is made to the consumer.

According to further refinements of the invention the support includes a rod with a hook at its free end. The rod is angled down towards its free end. A member on one side of the merchandise restricts movement of the merchandise about a first axis of the support. An additional member on another side of the merchandise restricts movement of the merchandise about the first axis of the support. The system further includes a pair of stoppers, one stopper being attached to the member near a free end of the member and the other stopper being attached to the additional member near a free end of the additional member. The stoppers restrict movement of the merchandise about a second axis of the support. The stoppers each include a pair of flexible flaps which enable merchandise to be inserted onto a support and removed from a support.

The flaps on the stopper serve the function of restricting movement of the merchandise about a second axis of the support while still enabling merchandise to be loaded onto the support and removed from the support.

DETAILED DESCRIPTION OF THE INVENTION

Figure 1:
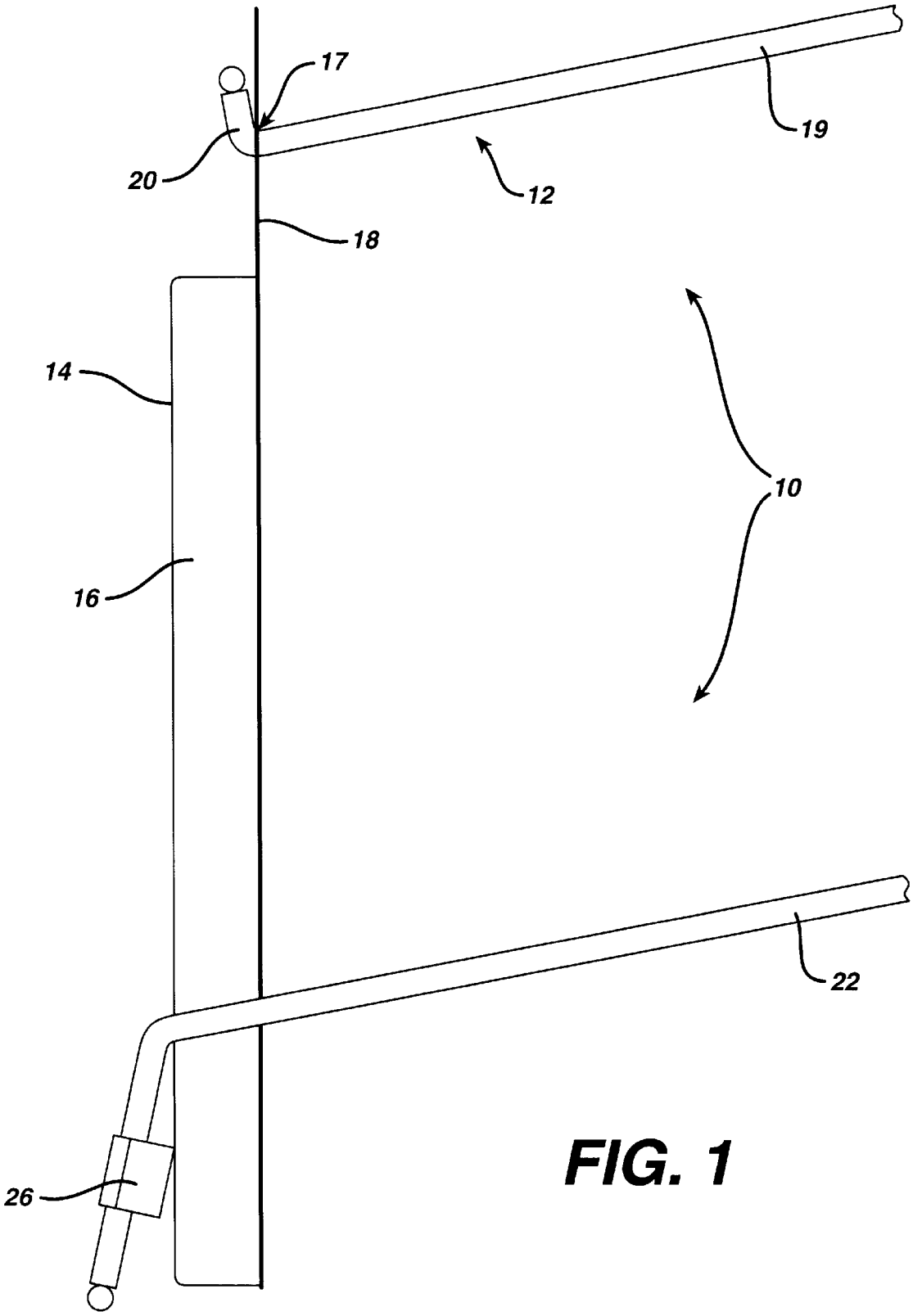
FIG. 1 is a side view of a merchandise display system.
Figure 2:
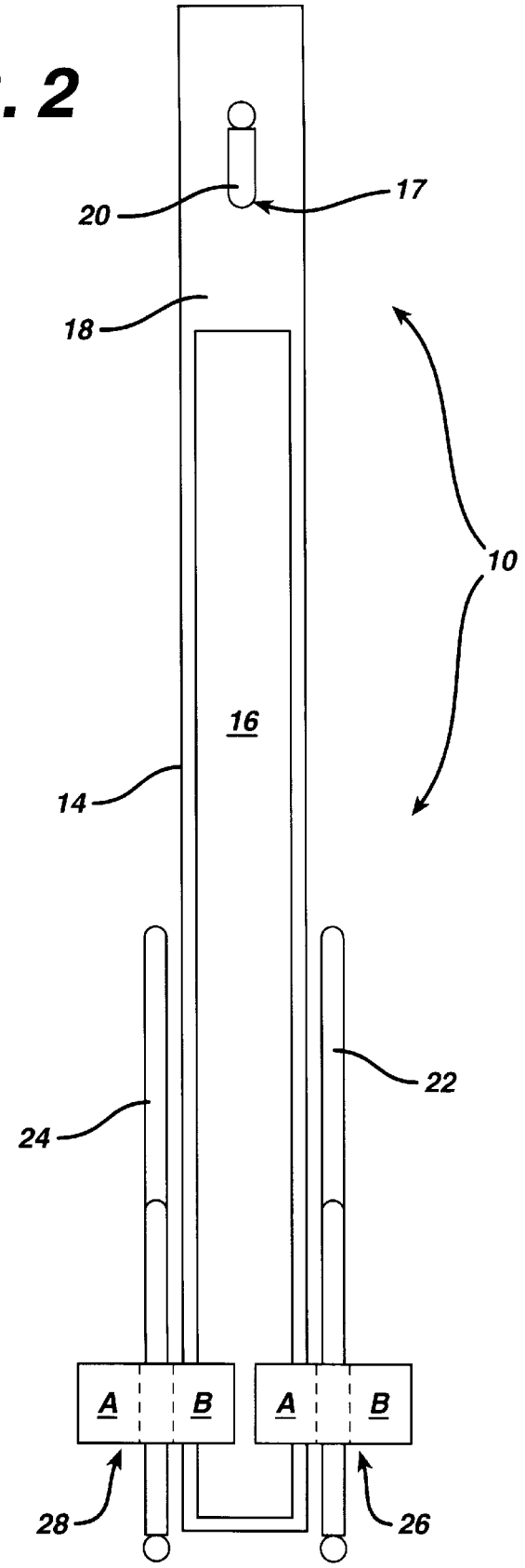
FIG. 2 is a front view of the display system of FIG. 1.
Figure 3:
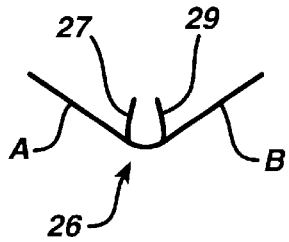
FIG. 3 is a top view of a stopper with flaps.

With reference to FIGS. 1–3, a merchandise display system 10 includes a support 12 from which merchandise 14 can be suspended. Support 12 can be made of metal or any other suitable material. Merchandise 14 can be, for example a toothbrush (not shown) in a blister pack 16 which is secured to a cardboard backing 18. The cardboard backing has a hole 17 in it near its top end The support includes a rod 19 with a hook 20 at the free end of the rod. The other end of rod 19 is attached to a display casing by any suitable means known to those skilled in the art. The rod is angled down towards its free end.

A pair of members 22, 24 are located on either side of merchandise 14. Members 22, 24 can be made of metal or any other suitable material. These members restrict movement of the merchandise about a first axis of the support which is co-linear with rod 19. In other words, merchandise 14 cannot swing from side to side as viewed in FIG. 2. The other end of each member 22, 24 is attached to a display casing by any suitable means known to those skilled in the art. The members are angled down towards their free end.

The merchandise display system further includes a pair of stoppers 26, 28. One stopper is attached to each of the members near a free end of the members. A pair of arms 27, 29 on each stopper allow the stopper to be press fitted onto its respective member. The stoppers are preferably made of plastic. Each stopper includes a pair of flexible flaps A, B. Each flap can rotate about an axis represented by a dashed line along one edge of the flap. The flap is allowed to rotate because the plastic along the dashed line is thinner than on other portions of the stopper. Thus, the thinned plastic along the dashed line acts like a hinge. The natural state of the flaps is shown in FIG. 3. Flaps 28B and 26A restrict movement of merchandise 14 clockwise about an axis which is perpendicular to the sheet of paper on which FIG. 1 is located and which is located about where rod 19 and hook 20 interface. In other words, merchandise 14 is inhibited from swinging clockwise as viewed in FIG. 1.

The merchandise display system operates as follows. In order to load merchandise 14 onto support 12, the merchandise is manipulated to slip hole 17 in backing 18 over hook 20. Merchandise 14 is then rotated counterclockwise (FIG. 1) to move the lower portion of the merchandise between members 22, 24. As merchandise 14 is pressed against flaps 28B and 26A, these flaps fold back (like saloon doors) to allow the merchandise to pass between the members. Although only one merchandise 14 is shown, a multiplicity of merchandise will typically be loaded into the system.

When a consumer desires to obtain merchandise 14, the consumer grasps the merchandise and lifts the merchandise up and off hook 20, clearing flaps 28B and 26A, not necessarily passing through flaps 28B and 26A. Any merchandise behind the merchandise removed gravity feeds towards hook 20 because support 12 is angled downward toward its free end. Hook 20 and flaps 28B and 26A in partnership prevent merchandise from falling off of support 12. Flaps 28B and 26A need to have enough resistance to inhibit merchandise on a fully loaded support 12 from passing out from between the members 22, 24.

What is claimed is:

1. A merchandise display system, comprising:

a support from which merchandise can be suspended; and means for restricting movement of the merchandise about the support, wherein the movement restricting means includes a member on one side of the merchandise for restricting movement of the merchandise about a first axis of the support, wherein the movement restricting means includes a stopper attached to the member near a free end of the member, the stopper restricting movement of the merchandise about a second axis of the support, wherein the stopper includes a flexible flap which enables merchandise to be inserted onto the support and removed from the support.

2. The merchandise display system of claim 1, wherein the support includes a rod.

3. The merchandise display system of claim 2, wherein the rod has a hook at its free end.

4. The merchandise display system of claim 3, wherein the rod is angled down towards its free end.

5. The merchandise display system of claim 1, wherein the movement restricting means includes an additional member on another side of the merchandise for restricting movement of the merchandise about the first axis of the support.

6. The merchandise display system of claim 5, wherein the movement restricting means includes a pair of stoppers, one stopper being attached to the member near a free end of the member and the other stopper being attached to the additional member near a free end of the additional member, the stoppers restricting movement of the merchandise about a second axis of the support.

7. The merchandise display system of claim 1, wherein the stopper includes an additional flexible flap which enables merchandise to be inserted onto and removed from an additional support.

* * * * *